United States Patent [19]

Hahn

[11] 4,187,648

[45] Feb. 12, 1980

[54] FORM FOR A MORTAR CAP

[76] Inventor: Raymond F. Hahn, 11 First St., Mine Hill, N.J. 07801

[21] Appl. No.: 893,943

[22] Filed: Apr. 6, 1978

[51] Int. Cl.[2] ..... E02D 29/14; E04G 15/06

[52] U.S. Cl. ..... 52/21; 249/11

[58] Field of Search ..... 52/19–21, 52/743; 249/4, 11, 12, 19, 22, 33; 404/25, 26

[56] References Cited

U.S. PATENT DOCUMENTS

| | | | |
|---|---|---|---|
| 2,166,632 | 7/1939 | Hardesty et al. | 52/21 X |
| 2,786,255 | 3/1957 | Heeb | 249/11 |
| 3,695,153 | 10/1972 | Dorris | 52/21 X |

FOREIGN PATENT DOCUMENTS

| | | | |
|---|---|---|---|
| 2242879 | 3/1975 | France | 52/20 |

*Primary Examiner*—J. Karl Bell

*Attorney, Agent, or Firm*—Thomas N. Neiman

[57] ABSTRACT

The Mortar Cap Form, according to the embodiment shown, comprises a plastic-preformed form in which to pour cement or mortar, to define a rectilinear footing for a catch basin. The form, in its basic configuration, presents channels, of right-angular juncture, defined by parallel walls of uniform width. in order to properly align the form with the top course of a catch basin, locating pins project downwardly from a bottom portion of the form, and from inner corners thereof, to pilotingly engage the catch basin course. The parallel walls are spaced apart by a series of traversing ribs; the ribs strengthen or reinforce the walls, and have voids formed therein to accommodate a flow of cement or mortar therethrough. In its supplemented configuration, the Mortar Cap Form includes a second form of parallel walls which also define channels for receiving cement or mortar, but the second form has tapered walls—to complement inclined road surfaces. Both the first and second forms have alignment devices for replaceably fixing the second form surmountingly upon the first form.

10 Claims, 9 Drawing Figures

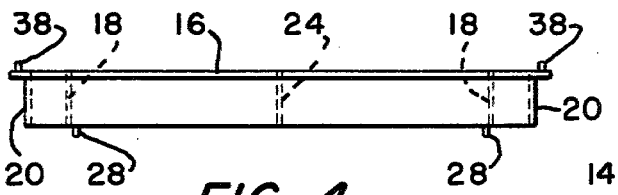
FIG. 4
FIG. 1
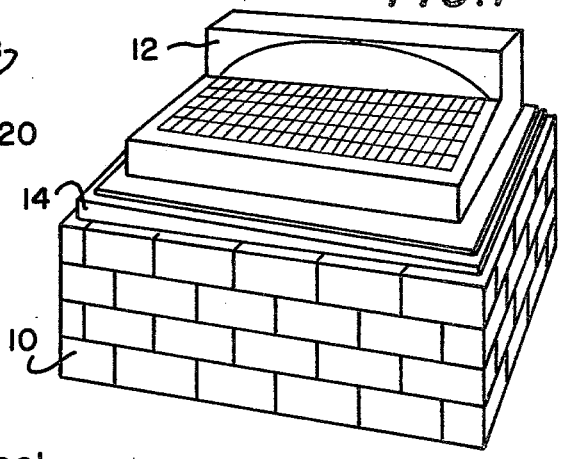
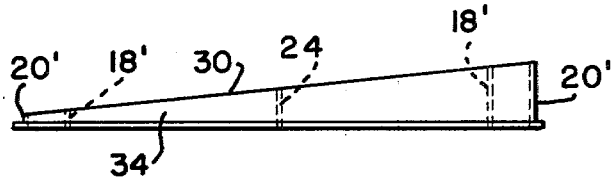
FIG. 6
FIG. 2
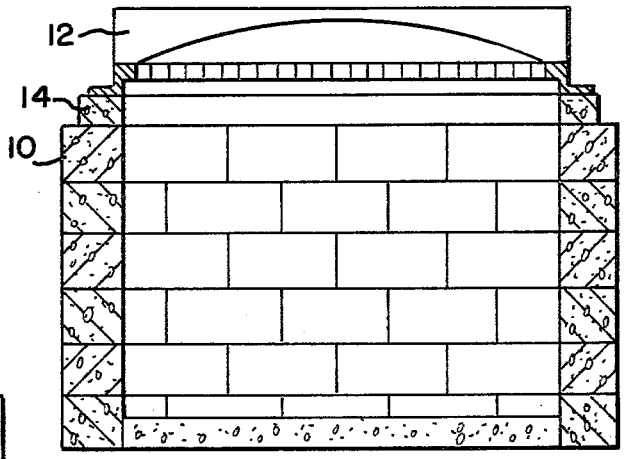
FIG. 5
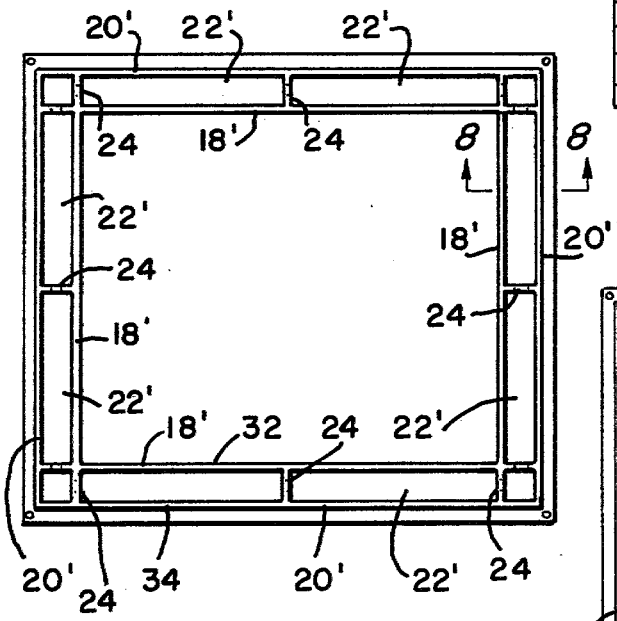
FIG. 3
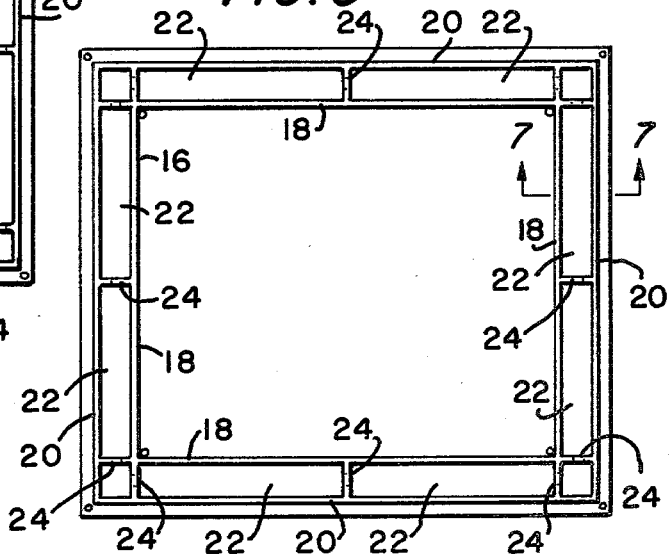

FORM FOR A MORTAR CAP

This invention pertains to forms for the receipt therewithin of cementitious materials, such as cement, mortar, and the like, for forming structures, and in particular to forms for mortar caps in which forms to create footings for catch basin gratings.

It is an object of this invention to set forth a form of the type noted which is simple of manufacture and use. Particularly, it is an object of this invention to disclose a form for a mortar cap, for receiving cementitious materials therewithin, such as cement, mortar, and the like, to define a footing for a catch basin grating, comprising at least first means defining multilateral, walled channels for receiving cementitious materials therewithin; and means projecting from said first means for pilotingly aligning said channels with a top course of a catch basin.

Further objects of this invention, as well as the novel features thereof, will become more apparent by reference to the following description taken in conjunction with the accompanying figures, in which:

FIG. 1 is an isometric view of a catch basin, grating, and mortar cap of the type formed through the use of the invention's innovative form;

FIG. 2 is a cross-sectional view taken vertically through the catch basin of FIG. 1, showing the mortar cap in relation to the road level and the uppermost course of the catch basin;

FIG. 3 is a plan view of the inventive first form, according to an embodiment thereof;

FIG. 4 is a side elevational view of the first form of FIG. 3;

FIG. 5 is a plan view of the inventive second form, according to an embodiment thereof;

FIG. 6 is a side elevational view of the second form of FIG. 5;

Figure 8:
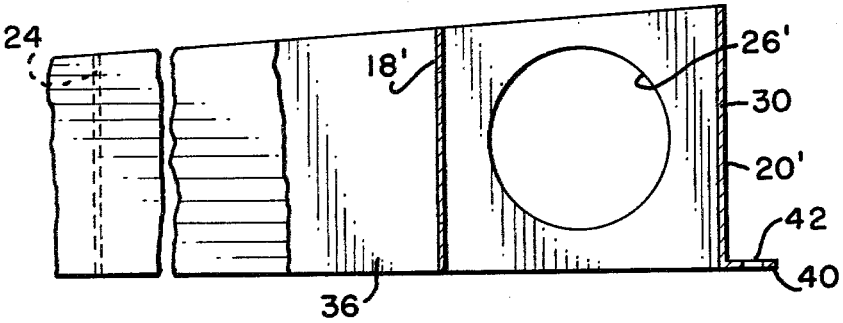
FIG. 8 is a cross-sectional view taken along section 8—8 of FIG. 5.
Figure 7:
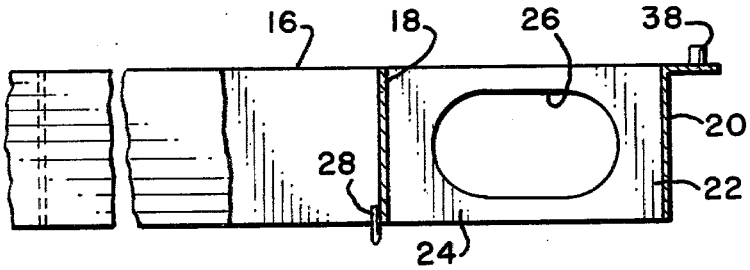
FIG. 7 is a cross-sectional view taken along section 7—7 of FIG. 3.

As shown in the Figures, a typical catch basin 10 supports a steel grating 12 thereupon through a mortar cap 14. According to my invention, a novel first form 16 of plastic material is used to cast or create the mortar cap 14. Form 16 comprises parallel inside and outside walls 18 and 20, respectively, which define channels 22 in which to receive cementitious materials—such as cement, mortar, and the like. The walls are spaced apart, and rigidized, by traverse webs 24, and each of the webs has an aperture 26 formed therein to allow the poured material to flow freely through the channels 22.

Within the right-angular junctures of the inner walls 18 are fixed tapered locating pins 28. The pins 28 are provided to assure an optimum alignment of the first form 16 pilotingly upon the uppermost course of the catch basin 10.

Many roads present sloped attitudes for a catch basin mortar caps. Accordingly, casting forms, such as form 16, which have uniform-width walls 18 and 20, will not accommodate for a slope. It is for this reason that my invention comprises a second, sloped form 30 to be used either in lieu of, or in combination with, the first form 16. Form 30 has channels 22' formed of inner and outer walls 18' and 20', but also parallel, sloped inner and outer walls 32 and 34. Channels 22' also have traverse webs 24 which, as shown in FIG. 8, also have apertures 26' formed therein.

Figure 9:
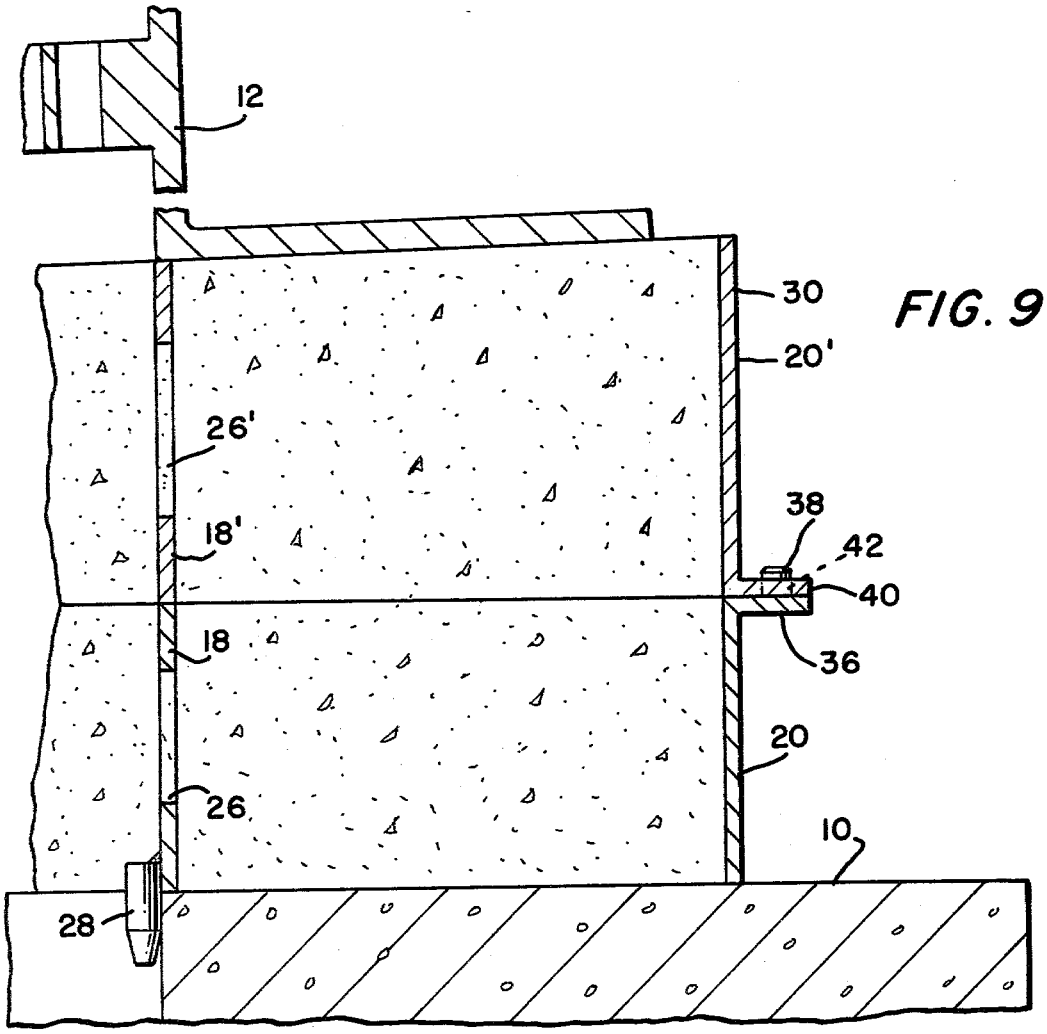
FIG. 9 is an enlarged, cross-sectional view through a portion of a combination of forms, according to the invention.

As noted, form 30 may be used in lieu of form 16, for a sloped road condition, or both forms are used together. The forms have means for engageably latching them together, with form 30 in surmounting relationship to form 16. Form 16 has a flange 36 circumscribing the uppermost portion of the structure and, at the corners thereof, has locating pegs 38 rising therefrom. Correspondingly, form 30 has a flange 40 circumscribing the lowermost portion thereof and, at the corners thereof, has locating-peg holes formed therein—to receive the pegs 38—each of the holes being denoted by index number 42. FIG. 9 shows the two forms assembled upon a catch basin 10 with mortar poured therewithin and supporting a steel grating 12.

Sizes, of course, are not delimiting of my invention. That is to say that the angle of slope to which the forms 30 are made is immaterial. So also, as to the width of walls 18 and 20, which define the depth of the forms 16; the same may be one inch, or two inches, etc. or any fractions and/or multiples thereof.

It is my purpose and intention for the forms 16 and 30 to remain with the catch basin installation, with the road surfacing material being used to completely encase the outermost surfaces of the forms 16 and 30. As cited earlier, the forms are prefabricated of plastic material. Now, this is proposed as the most economical form of production of the novel items. However, the invention is not limited to plastic forms 16 and 30. Accordingly, while I have described my invention in connection with specific embodiments thereof, it is to be clearly understood that this is done only by way of example, and not as a limitation to the scope of my invention, as set forth in the objects thereof and in the appended claims.

I claim:

1. A form for a mortar cap, for receiving cementitious materials therewithin, such as cement, mortar, and the like, to define a footing for a catch basin grating, comprising:

at least first means defining multilateral, walled channels for receiving cementitious materials therewithin; and means fixed adjacent to said channels and projecting from said first means for pilotingly aligning said channels with a top course of a catch basin.

2. A form for a mortar cap, for receiving cementitious materials therewithin, such as cement, mortar, and the like, to define a footing for a catch basin grating, comprising:

at least first means defining multilateral, walled channels for receiving cementitious materials therewithin; and means projecting from said first means for pilotingly aligning said channels with a top course of a catch basin; wherein said channels define right-angular junctures; and said aligning means comprises means projecting from said junctures.

3. A form for a mortar cap, according to claim 2, wherein:

said channels-defining means includes inner and outer, parallel walls for each of said channels.

4. A form for a mortar cap, according to claim 3, further including;

webs disposed in traverse of said channels for strengthening said walls; and means formed in said webs for facilitating a flow of cementitious materials through said channels.

5. A form for a mortar cap, according to claim 4, wherein:

said flow-facilitating means comprises voids.

6. A form for a mortar cap, according to claim 4, wherein:

said inner and outer walls are all of uniform width.

7. A form for a mortar cap, according to claim 6, further including:

second means defining multilateral, walled channels for cementitious materials, and comprising inner and outer walls for each of said channels; and wherein given ones of said walls of said second means are of uniformly diminishing width, defining said given walls of tapered configuration.

8. A form for a mortar cap, according to claim 7, wherein:

said first and second means have means cooperative for replaceably engaging said first and second means together, surmountingly.

9. A form for a mortar cap, according to claim 8, wherein:

said cooperative engaging means comprises alignment pegs carried by one of said first and second means, and alignment-peg holes, for said pegs, formed in the other of said first and second means.

10. A form for a mortar cap, according to claim 9, wherein:

said first means has a bottom portion, for engaging a top course of a catch basin, and a top portion for receiving said second means;

said second means has a bottom portion, for engaging said first means, and a top portion for receiving a catch basin grating; and said alignment pegs are carried by said top portion of said first means, and said peg holes are formed in said bottom portion of said second means.

* * * * *